US006158157A

United States Patent [19]

Hiscock et al.

[11] Patent Number: 6,158,157

[45] Date of Patent: Dec. 12, 2000

[54] PROMOTIONAL ARTICLE FOR USE IN RESTAURANTS OR THE LIKE

[75] Inventors: William Steven Hiscock, Shannonville; Anthony Gregg Davis, Frankford, both of Canada

[73] Assignee: 1011632 Ontario Inc., Ontario, Canada

[21] Appl. No.: 08/750,392

[22] PCT Filed: Jun. 8, 1995

[86] PCT No.: PCT/CA95/00343

§ 371 Date: Feb. 5, 1997

§ 102(e) Date: Feb. 5, 1997

[87] PCT Pub. No.: WO95/34060

PCT Pub. Date: Dec. 14, 1995

[30] Foreign Application Priority Data

Jun. 8, 1994 [CA] Canada ..... 2 125 466

[51] Int. Cl.[7] ..... G09F 3/18

[52] U.S. Cl. ..... 40/661.01; 335/285; 211/DIG. 1

[58] Field of Search ..... 40/426, 449, 600, 40/538, 661.01; 446/136; 335/285; 211/DIG. 1

[56] References Cited

U.S. PATENT DOCUMENTS

| | | | |
|---|---|---|---|
| 1,334,504 | 3/1920 | Parker | 335/291 |
| 1,711,469 | 4/1929 | Stratford . | |
| 2,270,331 | 1/1942 | Noble | 248/309.4 |
| 2,455,506 | 12/1948 | Leslie | 223/109 |
| 2,816,790 | 12/1957 | Johnson | 294/65.5 |
| 3,153,177 | 10/1964 | McFadyen | 317/159 |
| 3,162,313 | 12/1964 | Aimes | 211/60 |
| 3,472,391 | 10/1969 | Bolognesi | 211/65 |
| 3,635,513 | 1/1972 | Edwards | 294/65.5 |
| 4,166,649 | 9/1979 | Scholl | 294/65.5 |
| 5,096,154 | 3/1992 | Ellis | 248/683 |
| 5,152,711 | 10/1992 | Gross | 446/139 |
| 5,221,006 | 6/1993 | Plumlee et al. | 206/350 |

FOREIGN PATENT DOCUMENTS

| | | |
|---|---|---|
| 1747 | 1/1901 | Canada . |
| 1768 | 3/1901 | Canada . |
| 1779 | 3/1901 | Canada . |
| 94123 | 4/1905 | Canada . |
| 255512 | 11/1925 | Canada . |
| 50220 | 9/1982 | Canada . |
| 62018 | 11/1988 | Canada . |
| 73972 | 3/1994 | Canada . |
| 73973 | 3/1994 | Canada . |
| 73974 | 3/1994 | Canada . |
| 88 00 204 U | 9/1988 | Germany . |

*Primary Examiner*—Cassandra H. Davis

*Attorney, Agent, or Firm*—Milton Oliver; Ware, Fressola, Van Der Sluys & Adolphson LLP

[57] ABSTRACT

A promotional article for use in establishments such as bars or restaurants has the shape of a suspended enlarged replica of a beer bottle cap. The replica houses a magnet which enables discarded beer bottle caps to be attached underneath the promotional article. Eventually a cluster of beer bottle caps is created which further enhances the appeal of the promotional article. Two embodiments of the article are disclosed.

5 Claims, 4 Drawing Sheets

PROMOTIONAL ARTICLE FOR USE IN RESTAURANTS OR THE LIKE

FIELD OF INVENTION

The present invention relates to the art of promotional articles for use in restaurants, bars or the like establishments and in particular to those promotional articles which are suspended from the ceiling or the like and present an enlarged replica of items such as a bottle of a particular brand of a beverage, a glass of beer or the like. In its preferred embodiment, the invention is directed to the replicas of the beverage bottle caps such as beer bottle caps.

PRIOR ART

Promotional articles which present enlarged replicas of various products have long been known. The suspended promotional articles are often preferred as they catch the customers' attention more readily than articles such as posters. These promotional articles are often produced at a substantial cost to the manufacturer. It is therefore desirable that they attract attention of consumers such as restaurant or bar patrons.

SUMMARY OF THE INVENTION

It is an object of the invention to further increase the attractiveness of the articles of the above type.

In general terms, the present invention provides a promotional article for use in restaurants, bars and the like establishments. The invention presents a combination of (a) a decorative casing having exterior surface thereof adapted to carry promotional material; (b) magnetic field generating means disposed in and secured to said casing adapted to generate a magnetic field having power sufficient to suspend a cluster of discarded metallic objects exteriorly thereof adapted to maintain same in a suspended state; (c) said decorative casing being adapted to visually conceal the generating means but to allow attraction of the discarded objects to same from below.

Thus, the article provides a generally continuous display of the replica of a beer bottle cap while permitting accumulation of discarded beer bottle caps in a cluster at a location which appears to be said casing, The cluster provides additional and unusual visual feature further attracting the attention to the promotional article and thus to the promoted product.

BRIEF DESCRIPTION OF THE DRAWINGS

The invention will now be described by way of a prototype and of a preferred embodiment, with reference to the accompanying simplified diagrammatic drawings, wherein.

DETAILED DESCRIPTION

Figure 1:
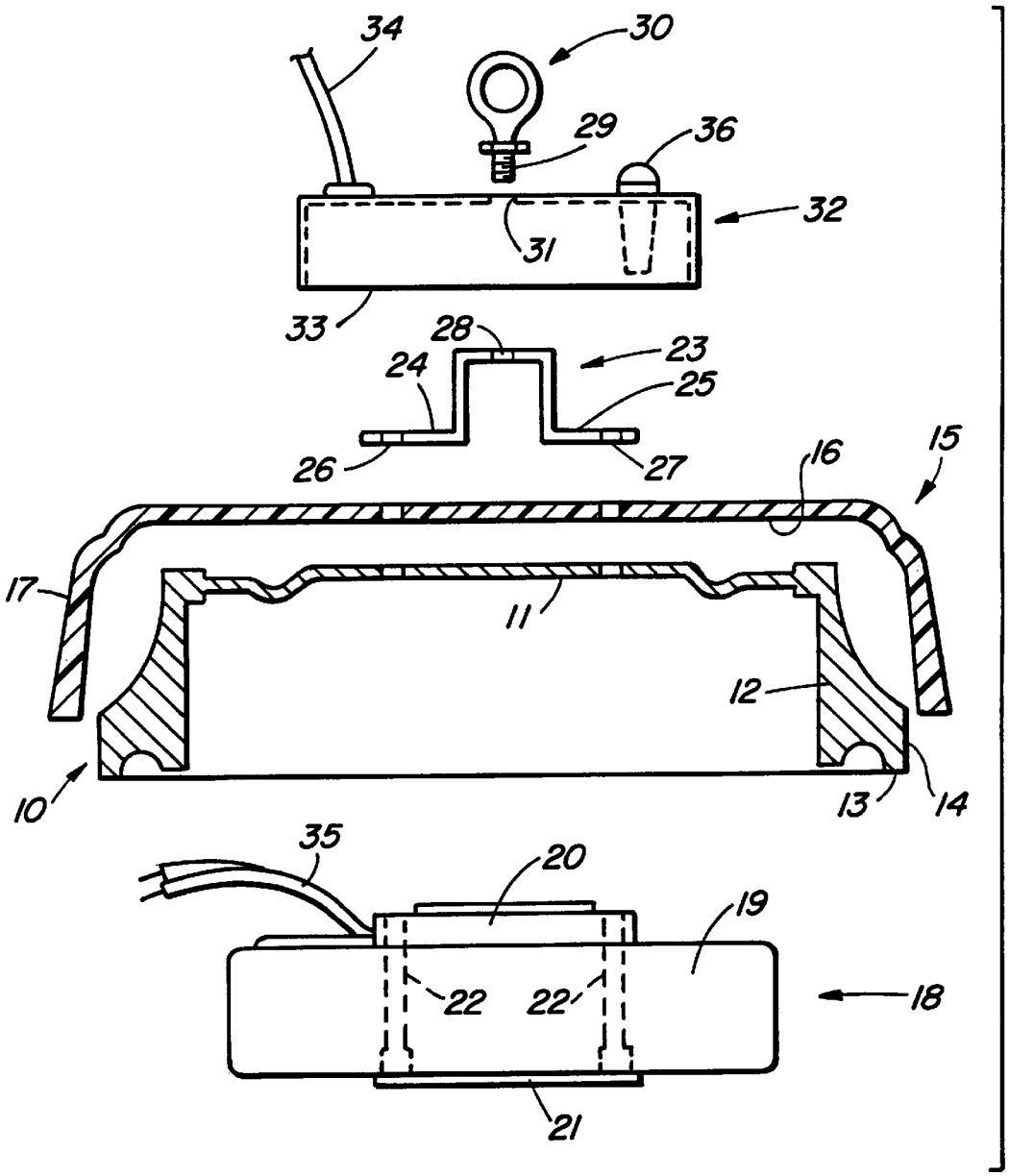
FIG. 1 is an exploded view of a prototype of the present invention with the parts shown in a side view and partly in section, indicative of how the different parts are assembled.

Turning firstly to FIG. 1, reference number 10 designates a ferrous metal housing made from low carbon cast steel. In the embodiment shown, the housing is made from cast iron. The housing is comprised of a solid inverse bottom portion 11 integral with a downwardly dependent annular skirt 12. At the bottom outer portion, the skirt 12 defines a peripheral rim 13 at a maximum outer diameter portion 14.

The housing 10 and in particular the axial length thereof and the maximum diameter portion 14 are determined such as to provide for a snug fit in a casing 15 presenting an enlarged replica of a beer bottle cap. The casing 15 also has an inverse bottom portion 16 and an annular, downwardly dependent skirt portion 17 which displays corrugations imitating the crimps of a beer bottle cap. As shown in the drawings, e.g. FIGS. 1 and 2, the ratio, of the diameter of the flat bottom portion 16, to the length of the skirt portion 17 of the casing 15, is about 4:1, generally corresponding to the ratio in a regular beer bottle cap. The interior of the casing 15 is large enough to fully accommodate the housing 10.

The housing 10, in turn, is adapted to receive an annular body of an electromagnet 18, generally referred to as "magnetic field generating means". The structure of the electromagnet itself is not a part of the invention. It merely presents a preferred embodiment of the "magnetic field generating means". It will therefore suffice to say that the electromagnet includes a coil 19 which is cotton taped and painted with epoxy to provide the desired insulation. As is well known, the coil 19 surrounds core of mild steel approximately 4 inches (100 mm) in diameter. Reference numbers 20, 21, are axial ends of the core. In a fully assembled state (FIG. 2), the lower axial end 21 presents a part of what is generally referred to as "a bottom outer portion" of the device. Two passages 22 are adapted to receive mounting bolts (not shown).

Disposed above the bottom portion 16 of the casing 15 is an inverted U-shaped bracket made from a steel strip and bent to provide opposed mounting extensions 24, 25, each provided with a bore 26, 27 concentric with the passages 22 and with appropriately provided passages in the bottom portions 16, 11. The bracket 23 also has a central threaded bore 28 complementary with the threaded stem 29 of a suspension eyelet 30 disposed at a top outer portion of the device. Typically, the bracket 23 would be secured to the rest of the assembly by a pair of bolts (not shown) passing through the passages 26, 27, through the bottom portions 16, 11 and the passages 22 where, at the lower end, a complementary nut with a spring washer or the like (the bolt assembly not shown) would firmly secure all parts together.

The stem 29 is adapted to pass through a passage 31 in the top portion of an inverse box-shaped cover or junction box 32 which—in the assembled state—receives the entire bracket 23 and abuts with its lower edge 33 against the upper surface of the bottom 16 of the casing 15.

The diagrammatic representation of FIG. 1 also includes an indication of a flexible power cord 34 including leads 35, which can pass through appropriate passages (not shown) in the bottom portions 11 and by the extension 24 to the inlet of the hose 34. The power cord, of course, leads to an appropriate source, of power, e.g. 120 AC. As is well known in the art of electromagnets, suitable AC/DC converter (not shown) is preferably included in the junction box 32. Reference number 36 designates diagrammatically a fuse holder assembly. As in case of the leads 35, the holder is shown only diagrammatically it being understood that the fuse presents an arrangement as may be prescribed by local standards for the circuitry of an electromagnet.

Figure 2:
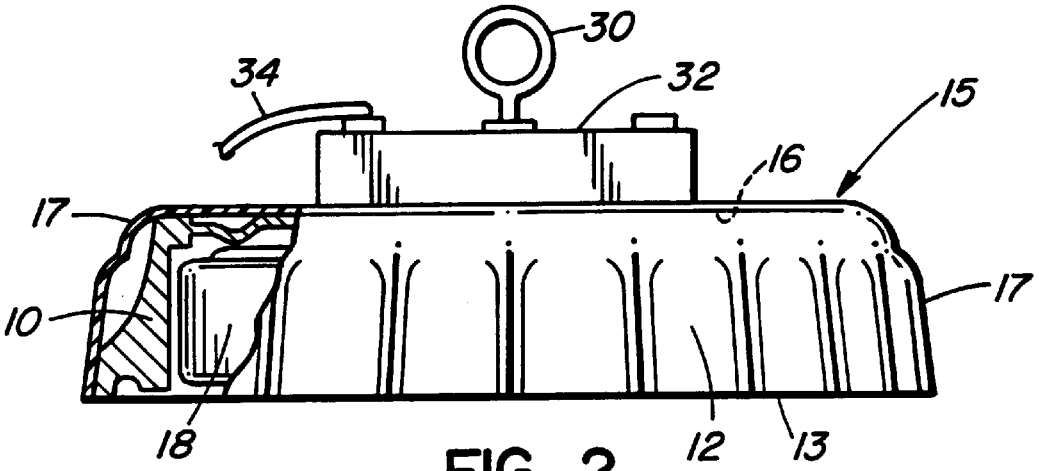
FIG. 2 is a side view of the promotional article in assembled form, with certain parts omitted for clarity.

Looking at FIG. 2, it can be seen that the entire housing 10 of the electromagnet is received within the casing 15. The casing would typically display the name or some other promotional indication of a brewery or the like. With the device suspended from the eyelet 30 above a support surface (not shown in the drawings), for instance, above the bar top, and the magnetic field generating means 35, 19, 10 energized, the device is capable of holding, in a suspended cluster (not shown in FIG. 2), a large number of discarded beer bottle caps or the like, thus providing additional unusual appearance of the suspended promotional article and also adding to the convenience of the bar server or patron.

It will thus be seen that, by a simple modification, an additional appearance feature may be given to the suspended promotional article which provides an additional attention attracting feature, particularly as the cluster of the discarded caps grows. The removal of the cluster, of course is a simple matter which may be aided by a switched wall outlet to de-energize the magnetic field generating means.

Figure 3:
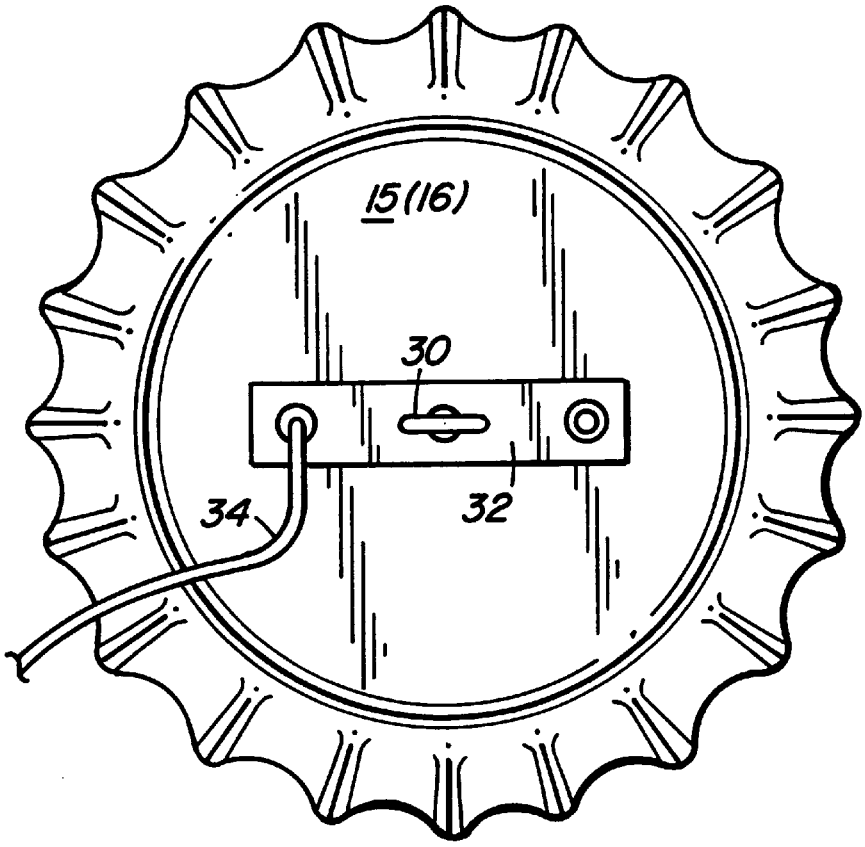
FIG. 3 is a top plan view of the representation of FIG. 2.
Figure 5:
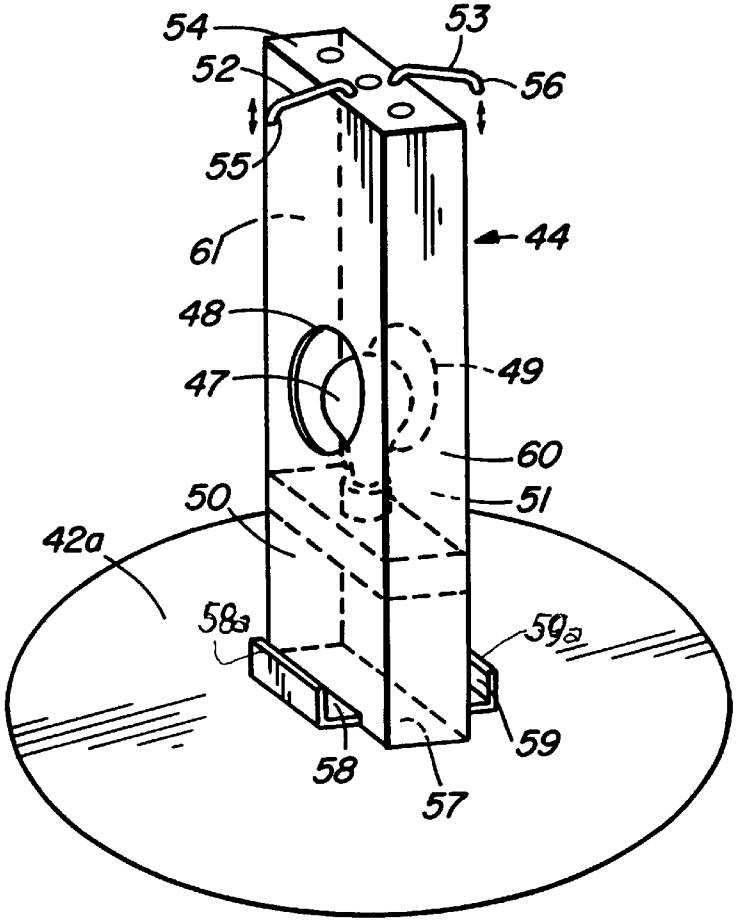
FIG. 5 is a simplified, diagrammatic perspective similar to that of FIG. 4, with certain parts removed.
Figure 4:
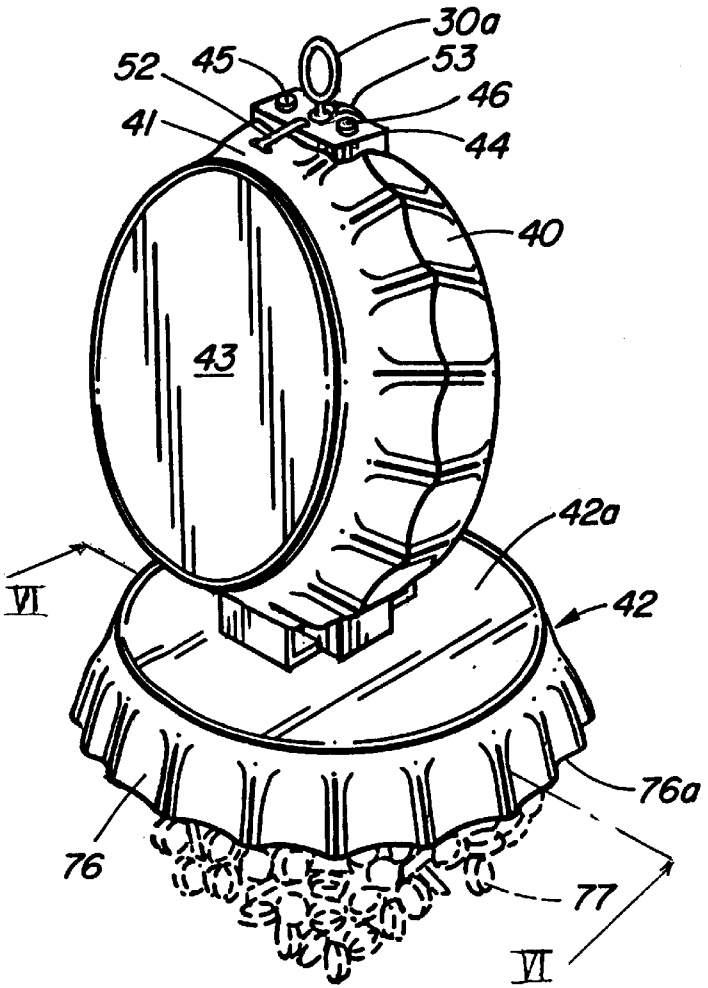
FIG. 4 is a perspective view of a preferred embodiment of the present invention.
Figure 6:
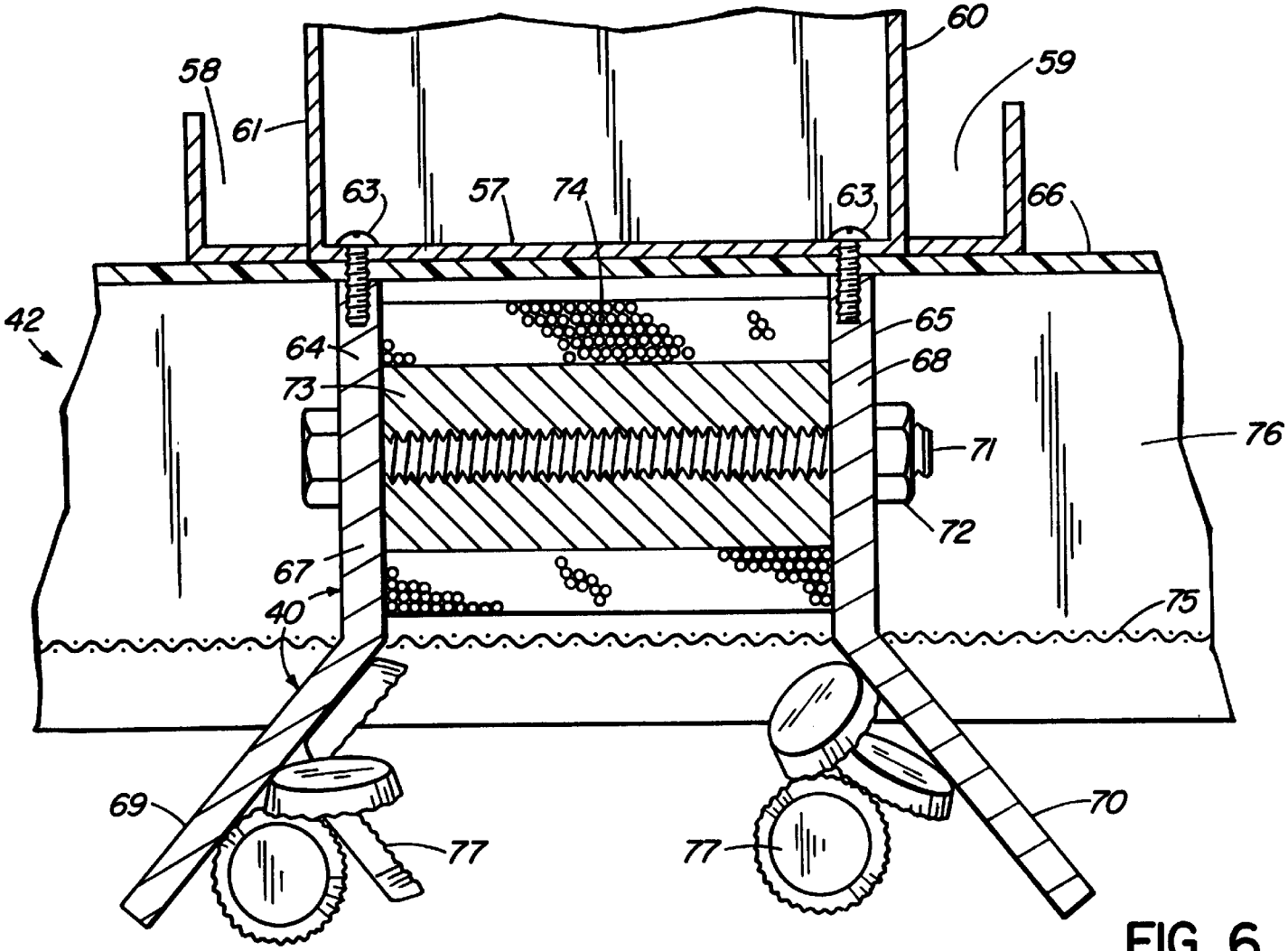
FIG. 6 is a diagrammatic, partial view of the arrangement of FIG. 4 taken on section VI—VI of FIG. 4 with certain parts omitted.

Turning now to the embodiment shown in FIGS. 4–6 and referring firstly to FIG. 4, the second embodiment of the invention is based on the same principle but presents an arrangement which is preferred and is believed to be superior to that showing in FIGS. 1–3. It is less expensive to make and is more attractive and also more efficient as a device for holding discarded small objects made from a ferromagnetic material, such as beer bottle caps at the desired location, in the embodiment shown, just below the enlarged replica of a beer bottle cap.

The arrangement of FIG. 4 comprises a pair of upright enlarged replicas 40, 41 of beer bottle caps. The replicas are made from a translucent plastic material for instance acrylic or polycarbonate it being understood that the material is entirely optional. It should however be translucent and non-ferromagnetic. Another replica 42 of generally the same appearance as replicas 40, 41, is displayed in a horizontal position. This provides the appearance as if the replica 42 supported the identical upright replicas 40, 41. For clarity, the replicas 40, 41 are also referred to as "a disk-shaped section". The combination of the replicas just described therefore presents another embodiment of an ornamental casing of the device.

The vertical caps 40, 41 display each a flat, generally planar circular surface such as surface 43 which provides a larger space for a promotional material such as a trademark or trade name of a beer (the promotional material not shown in the drawings). The opposed ends of the replicas 40, 41 define a peripheral seam at what appears as the rim sections of the relicas 40, 41 abutting each other (FIG. 4). The horizontal replica likewise displays a flat top 42*a*.

The vertical caps are secured to a centrally disposed junction box 44. The junction box 44 houses electrical devices required for the operation of the device. Like the junction box 32, it includes a suspension eyelet 30*a* which, like the eyelet 30, mentioned above, is located at a top outer portion of the device. Item 45 is a diagrammatic representation of a power cord similar to the power cord 34 of the prototype and 46 is a fuse similar to fuse 36 of the prototype. The junction box 44 also houses a rectifier bridge (not shown) or some other suitable device for converting AC to DC if required for the operation of the device as will be later described.

Another item which is housed in the junction box 44 is a light bulb socket adapted to receive a light bulb 47. The socket is so arranged that the requisite light built 47 is centred on apertures 48, 49 provided in rectangular face walls 50, 51. As best seen from FIG. 5, the junction box 44 has the shape of an upwardly elongated, flattened rectangular prism.

A hook shaped spring clip arms 52, 53 project centrally from a top wall 54 of the junction box 44. The free end of each arm 52, 53 has a downwardly turned hook-like free end 55, 56. The bottom wall 57 of the junction box 44 is generally flush with channels 58, 59, one extending laterally across the lower end of each of the face walls 50, 51.

Each clip 52–53 co-operates with the associate channel 58–59 to resiliently hold the respective vertical cap 41, 40 by engaging complementary cutouts (not shown) provided in each vertical cap 40, 41. The lower end of each vertical cup has a cutout (not shown) complementary with the upwardly turned outer flanges 58*a*, 59*a* of the channels 58, 59. Since the clips 52, 53 are resilient, it is a simple matter of raising the respective clip 52, 53 and to then lift and remove the associated vertical cap 41, 40 in order to gain access to the bulb 47 and generally to the junction box for maintenance purposes or changing the promotional display. The opposed side walls of the junction box 44 are designated with reference numbers 60, 61.

Turning now to the partial view of FIG. 6, the orientation of the bottom wall 57 of the junction box and of the side walls 60, 61 is readily apparent. Each of two screws 63, 63 passing through the bottom wall 57 fixedly secures to the bottom wall 57 of the junction box 44 one of two angular plates made from a ferromagnetic material, e.g. steel.

A flat top face wall 66 of the horizontal cap 42 is interposed between the upper edges of the angular plates 64, 65 and the bottom wall 57. Thus, the cap 42 is held in fixed securement to the bottom wall 57 by the same pair of screws 63, 63 as hold the angular plates 64, 65.

Each angular generally downwardly dependent plate has a generally vertical section 67, 68 and an outwardly and downwards inclined free end section 69, 70. Fixedly secured between the vertical sections 67, 68 by a lateral bolt 71 and a nut 72 is a cylindric core 73 enveloped by a coil 74. The coil 74 is connected to a suitable DC source in the junction box 44 (connection not shown) as is well known in the art of electromagnets. The core is from a highly ferromagnetic material, e.g. low carbon steel. Since the angular plates 64, 65 are also from a ferromagnetic material, the free end portions 69, 70 in effect become both magnetic poles of an electromagnetic assembly as shown.

A screen 75, for instance made from aluminum, is disposed approximately at the level of obtuse angled corners between the vertical sections 67, 68 and the outwardly flared free end sections 69, 70. The outer periphery of the screen 75 is fixedly secured, for instance by a glue, to the inner periphery of the downwardly directed skirt 76 (FIG. 4) of the horizontal cap 42. The skirt 76 defines a peripheral edge 76*a* which is at a level below the magnetic coil 74. The purpose of the screen 75 is to make sure that small discarded objects which form an eye catching cluster 77 such as beer bottle caps are magnetically attracted and adhere to the free end section 69, 70 but do not reach the region of the electromagnetic coil and core assembly, from which they might be difficult to remove.

It is preferred that about two-thirds of the overall length of the free end sections 69, 70 project below the downwardly open horizontal cap so as to readily attract the discarded beer bottle caps. In operation, they are soon enveloped by the beer bottle caps and are no longer visible, while the beer bottle caps themselves provide the appearance of an eye catching cluster 77 located below the horizontal cap.

Based on the two embodiments disclosed, it will be appreciated that many further modifications of the invention as described may exist. As an example only, the magnetic field generator may be a permanent magnet; the casing may be of a different configuration. For instance, the shape of a beer bottle, a keg, a number of bottle caps or many other shapes are readily conceivable. Another possibility is a dispenser of, say, paper clips, associated with a casing promoting a stationery store, or a toy holder promoting the particular product, e.g. miniature toy automobiles. The embodiments disclosed have their magnetic field oriented below the casing. This is not to say that the casing could not assume a different appearance, in which the magnetic field would be oriented sideways to suspend articles on the side rather than below the casing. These and many other modifications, while departing to a greater or lesser degree from the embodiments disclosed, do not depart from the spirit of the invention. Accordingly, we wish to protect by Letters Patent which may issue on this application all such embodiments which fairly fall within the scope of the present invention.

What is claimed is:

1. A promotional display device, comprising (a) a casing which includes a generally circular, flat, normally generally horizontal upper surface portion;

(b) a generally frustoconical, short, downwardly divergent skirt having a length which is only a fraction of the diameter of the upper surface portion, said skirt depending downwardly from the periphery of said upper surface portion and defining a lower peripheral rim portion vertically spaced from said upper surface portion;

(c) a plurality of straight generally upright ribs projecting from an outer surface of said skirt and disposed at an equidistant spacing from each other;

(d) a ratio of the length of the skirt relative to the diameter of the upper surface portion adapted to thus generally correspond to that of a regular crimped beer bottle cap, whereby the upper surface portion and the skirt has the exterior configuration of an enlarged beer bottle cap;

(e) suspension means secured to said device to suspend same in a generally stationary fashion at a predetermined location whereby the casing provides an enlarged imitation of a suspended beer bottle cap;

(f) magnetic field generating means secured inside the casing and adapted to generate a generally downwardly directed magnetic field having strength sufficient to hold a cluster of discarded beer bottle caps;

(g) a pair of opposed, circular, flat, normally generally vertical side surface portions having a generally horizontal axis;

(h) generally frustoconical, normally generally horizontal, inwardly divergent frustoconical skirt portions, having each a length which is only a fraction of the diameter of aid vertical side surface portions, projecting from the periphery of each said vertical side surface portion and defining a peripheral seam portion horizontally equidistantly spaced from said side surface portions;

(i) a plurality of straight, generally horizontal ribs projecting from an outer surface of each frustoconical skirt portion and disposed at an equidistant spacing from each other;

(j) the ratio of the length of each skirt portion relative to the diameter of the respective side surface portion generally corresponding to a skirt length/diameter ratio of a regular beer bottle cap; and (k) said disc-shaped section being made from a translucent material and housing support device for a light source adapted to illuminate the interior of the disc-shaped section, whereby the device provides an eye-catching feature of an enlarged replica of a beer bottle cap with a cluster of discarded beer bottle caps projecting downwardly from said casing, enhanced by displaying an additional configuration of an enlarged pair of beer bottle caps turned to each other with rim portions thereof, and by providing the possibility of illuminated appearance of the enlarged pair of beer bottle caps.

2. A promotional display device for use in households, stores, restaurants, and bars, said device including a decorative casing having an exterior surface thereof adapted to display promotional material, characterized in that (a) there is a magnetic field generating device secured to said casing and adapted to generate a magnetic field having magnetic power sufficient to hold, generally exteriorly of the casing, a cluster of objects thematically related to said promotional material, said device thus being adapted to allow accumulation of said objects in a cluster at points outside of the casing whereby, in use, apart from displaying the promotional material, the promotional display device displays the promotional material while permitting gradual build-up of said cluster, thus providing an unusual visual feature attracting attention to the promotional display device;

(b) the casing is an enlarged replica of a beverage bottle cap, having a flat circular portion and a skirt portion extending from a periphery of said flat circular portion, a ratio of the diameter of the flat circular portion to the length of the skirt portion being adapted to generally correspond to that of a regular beer crimped bear bottle cap, said generating means being adapted to generate magnetic field having power sufficient to retain a cluster of metallic bottle caps, whereby the device is capable of providing an appearance combining the images of a large bottle cap and of a cluster of regular bottle caps suspended therefrom;

(c) the generating device includes a cylindric electric coil having a generally horizontal axis and surrounding a ferromagnetic core;

(d) a pair of generally downwardly dependent plates is fixedly secured to axial ends of the core such that a part of each plate projects below the level of the lowermost peripheral rim portio of the casing, whereby the part assists in the formation of the cluster; and (e) at least a portion of each said part projecting below the level of the lowermost peripheral rim portion of the casing is inclined downwardly and away from a vertical axis of the casing to provide a funnel-like space for the cluster.

3. The device is recited in claim 2, characterized in that there is a non-magnetizable screen separating the inner space of the casing into an upper chamber which houses said generating device, and a downwardly open lower section, said screen being adapted to maintain said cluster near and below the level of the lowermost peripheral rim portion.

4. The device as recited in claim 2, characterized in that the casing is fixedly secured to a bottom portion of an upright junction box, that said junction box is provided with a suspension arrangement and with a securement arrangement releasably securing to the junction box a pair of vertical caps which are of a generally identical configuration and size as the casing, the securement arrangement being arranged to hold the vertical caps with flat surfaces thereof generally parallel and spaced from each other, and with edges of skirt portions of the vertical caps generally in abutment against each other.

5. The device as recited in claim 4, characterized in that the vertical caps are made from a translucent material and in that the junction box includes a support device for a light source so arranged and disposed as to illuminate the interior of at least one of said vertical caps.

* * * * *